US006767075B1

(12) United States Patent
Takada et al.

(10) Patent No.: US 6,767,075 B1
(45) Date of Patent: Jul. 27, 2004

(54) IMAGE FORMING DEVICE

(75) Inventors: Shingo Takada, Tokyo (JP); Michitaka Fukuda, Tokyo (JP); Koji Terasawa, Tokyo (JP); Hideyuki Kitajima, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 09/936,466

(22) PCT Filed: Mar. 21, 2000

(86) PCT No.: PCT/JP00/01701

§ 371 (c)(1),
(2), (4) Date: Sep. 10, 2001

(87) PCT Pub. No.: WO00/54974

PCT Pub. Date: Sep. 21, 2000

(30) Foreign Application Priority Data

Mar. 18, 1999 (JP) ..... 11/73051

(51) Int. Cl.[7] ..... B41J 29/393
(52) U.S. Cl. ..... 347/19
(58) Field of Search ..... 347/19, 14, 86, 347/85, 6, 5, 7, 23, 91, 12, 10, 11, 84, 77; 250/222.1, 229; 73/323, 327

(56) References Cited

U.S. PATENT DOCUMENTS 5,856,833 A * 1/1999 Elgee et al. ..... 347/19
5,997,121 A * 12/1999 Alfather et al. ..... 347/7
6,443,567 B1 * 9/2002 Hayashi et al. ..... 347/85
6,460,962 B1 * 10/2002 Dietl et al. ..... 347/19

* cited by examiner

*Primary Examiner*—Stephen D. Meier
*Assistant Examiner*—Charles Stewart, Jr.
(74) *Attorney, Agent, or Firm*—Dellett & Walters

(57) ABSTRACT

An image forming device capable of detecting the presence/absence of ink as well as whether an ink tank is mounted. A detachable ink tank 32 on a carriage 31 includes a prism 32C, and a reflective optical sensor 33 detects the presence/absence of ink depending on the difference in refractive index between the two states, that is, filled with ink and empty. A reflector lever 35, movable in response to the ink tank 32 being mounted or not, is provided on the bottom of an ink tank holder 34. The reflector lever 35 has one end fixed on a lower part of the ink tank and the other end that is a free end consisting of a triangular reflector 35D. The reflector lever 35 is normally urged upward by a resilient member 35A, and it will not direct the reflection toward the sensor 33 in the absence of the ink tank whereas it is deformed in the presence/absence of the ink tank to direct the reflection toward the sensor 33. As a result, the presence/absence of the ink tank is detected.

10 Claims, 17 Drawing Sheets

OUTPUT VOLTAGE=L
LIGHT EMITTER
21
LIGHT RECEIVER
22
33

OUTPUT VOLTAGE=L
23
21
22
33

OUTPUT VOLTAGE=L
32
25
β
γ
α
REFRACTED
33

OUTPUT VOLTAGE=H
TOTAL INTERNAL REFLECTION
33

FIG. 5
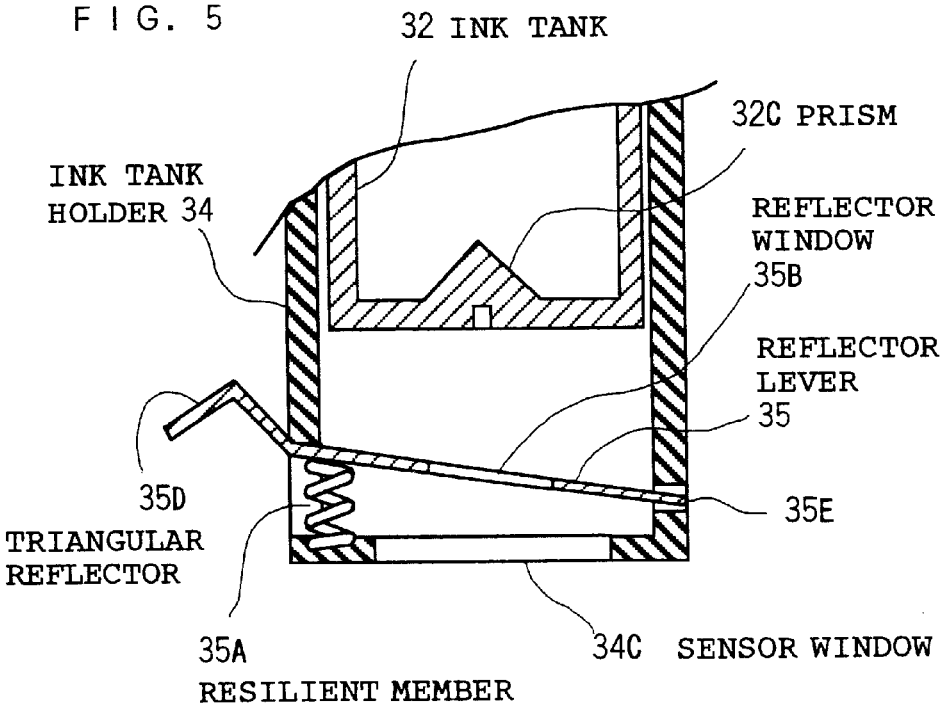
FIG. 6 (a)
FIG. 6 (b)
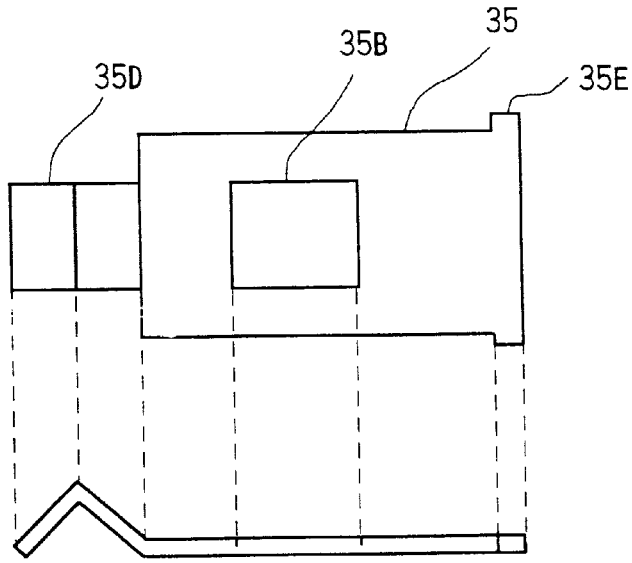
FIG. 6 (c)
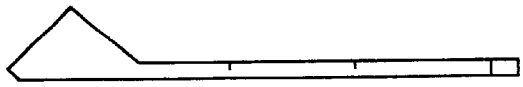

INK DETECTION OUTPUT

INK TANK DETECTION OUTPUT

FIG. 7 (c) INK AND INK TANK DETECTION OUTPUT

| | INK DETECTION OUTPUT | INK TANK DETECTION OUTPUT |
|---|---|---|
| INK IS PRESENT AND INK TANK IS INSTALLED | H | L |
| NO INK IS PRESENT AND INK TANK IS INSTALLED | L | L |
| NO INK TANK IS INSTALLED | H | H |

35B REFLECTOR WINDOW
TRIANGULAR REFLECTOR 35D
50C RESILIENT MEMBER
35E SUPPORTING POINT

50 REFLECTOR LEVER 35D
50C RESILIENT MEMBER

35B REFLECTOR WINDOW
50C RESILIENT MEMBER
50D SHAFT

50
REFLECTOR
LEVER 35C
50C RESILIENT
MEMBER

FIG. 17 BOTTOM SURFACE OF INK TANK

FIG. 20 (a) WHEN VIEWED FROM ARROW B IN FIG. 20(B)
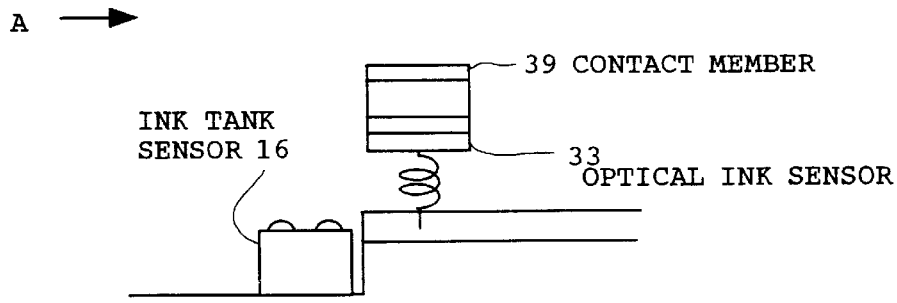
FIG. 20 (b) WHEN VIEWED FROM ARROW A IN FIG. 20(A)
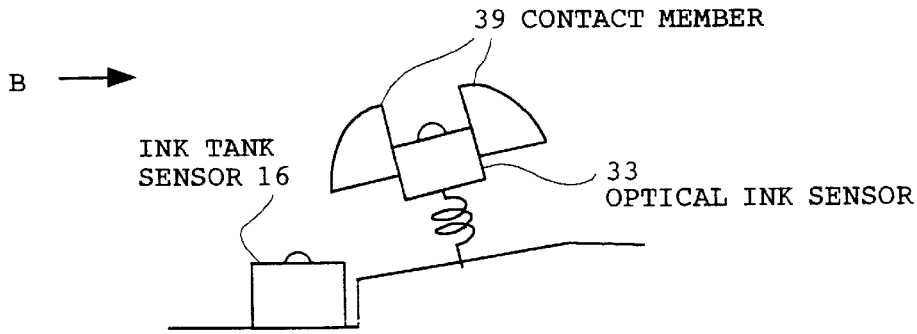

IMAGE FORMING DEVICE

TECHNICAL FIELD

The present invention relates to a method for detecting, in an ink-jet image forming device, the presence/absence of ink in a detachable ink tank that has paths through which ink is supplied to ink-jet nozzles and for detecting the presence/absence of the ink tank.

BACKGROUND ART

In accordance with a conventional ink-jet print method, an image may be formed by ejecting ink on an on-demand basis. Print images have changed from monochromatic images to color images and, as color printing becomes more popular, a lot of image forming devices have detachably structured ink tanks, each for cyan, magenta, yellow, light cyan, light magenta, light yellow and black. Ink in those colors is stored in separate ink tanks. In general, an ink container that may be detachably mounted on an ink-jet head with ink jet nozzles provided thereon is called an ink tank, while a unit integrally composed of a head with an ink container is called an ink cartridge. In this specification, they are both called ink tanks.

Ink in those ink tanks is consumed differently and, the user must individually exchange exhausted ink tanks or replenish an exhausted ink tank through a path.

Japanese Patent Laid-Open Publication No. Hei 8-108543 and Japanese Patent Laid-Open Publication No. Hei 9-226149 disclose a technique wherein an optical reflector prism located at the bottom of an ink tank is combined with a reflective optical sensor to sense the ink.

With reference to FIGS. 1(*a*)–1(*d*), the principle of an ink sensing operation performed by the combination of the reflector prism and the reflective optical sensor will be described.

When a prism-structured ink sensor window is observed with a reflective optical sensor 33 composed of an emitter 21 and a receiver 22 of an infrared ray, the light from the emitter 21 does not reach the receiver 22 as shown in FIG. 1(*a*) if no object is present. Also, when a non-prism-structured object 23 is in the sensing position of the optical reflective sensor as shown in FIG. 1(*b*), the light from the emitter 21 does not reach the receiver 22 either. In addition, when liquid (ink) is present in the prism-structured part as shown in FIG. 1(*c*), the incident ray is refracted at the interface because of a refractive index between the prism-structured member (glass, polypropylene, etc.) and the liquid. At this time, the refractive index is represented by $n(\alpha \rightarrow \beta) = \sin\alpha / \sin\beta (>1)$, where $\alpha$ is the incident angle and $\beta$ is the refractive angle. As disclosed in Japanese Patent Laid-Open Publication No. Hei 7-164626, the refractive index (n) of air with respect to ideal gas is represented as n=about 1.0, the refractive index (n) of ink as n=about 1.4, and the refractive index (n) of polypropylene as n=about 1.5. Therefore, the polypropylene to ink refractive index $n(\text{poly} \rightarrow \text{ink}) = 1.4/1.5 \approx 0.93 \approx \sin 68°/\sin 90°$, and polypropylene to air refractive index $n(\text{poly} \rightarrow \text{air}) = 1.0/1.5 \approx 0.67 \approx \sin 42°/\sin 90°$.

This means that, when the polypropylene-to-ink incident angle is 68°, the refractive angle is 90°, that is, the incident ray is refracted in the direction of the interface vector at the interface between two objects (this incident angle is called the critical angle) and that, when the incident angle $\alpha > 68°$, the incident ray makes a total internal reflection.

This also means that, when the polypropylene-to-air incident angle is 42°, the refractive angle is 90°, that is, the incident ray is refracted in the direction of the interface vector at the interface between two objects and that, when the incident angle $\alpha > 42°$ (critical angle), the incident ray makes a total internal reflection.

Based on this principle, creating a prism-structured polypropylene ink tank container, whose incident angle of the infrared ray from the emitter 21 is $42° < \alpha < 68°$, and installing the container as described above causes the light to refract when ink is present, and causes the light to make a total internal reflection when no ink is present. Therefore, when no ink is present in the prism-structured part as shown in FIG. 1(*d*), that is, when air is present there, a total internal reflection occurs and light from the emitter 21 reaches the receiver 22 to indicate that no ink is present.

However, when no ink tank is present on the holder (FIG. 1(*a*)), the same result is obtained as when an ink tank fully filled with ink is installed (FIG. 1(*c*)). Therefore, if no measure is taken, there is a possibility that, when no ink tank is present, the sensor senses that ink is present and, as a result, printing is done with no ink supplied to the print head (nozzles). This could damage the nozzles of the recording head of an ink-jet image forming device because of overheating, causing problems such as a head damage.

In view of the foregoing, it is an object of the present invention to provide an image forming device capable of detecting the presence/absence of ink, as well as whether an ink tank is mounted.

DISCLOSURE OF INVENTION

An image forming device according to the present invention for forming an image with an ink jet method comprises an ink tank detachable on a carriage; a prism disposed in the ink tank, the prism being covered with ink when the tank is filled with ink and being exposed when the tank is empty; an optical ink sensor that has a light emitter for projecting light onto the prism and a light receiver for receiving a reflected light of the projected light to detect a presence/absence of ink in the ink tank; and a reflector movable between a first position and a second position according to whether or not the ink tank is installed on the carriage, wherein the reflector, in the second position with the ink tank installed, reflects the light from the optical ink sensor back to the optical ink sensor and wherein the reflector, in the first position with no ink tank installed, does not return the light from the optical ink sensor back to the light receiver.

This allows an image forming device to detect the presence/absence of ink reliably, as well as a state regarding whether an ink tank is mounted.

The reflector comprises, with respect to the optical ink sensor, a reflective surface similar in function to the prism, and the optical ink sensor is used both to detect the presence/absence of ink and to detect the presence/absence of the ink tank. This configuration reduces the number of required parts.

The image forming device may further comprise an optical ink tank sensor for detecting a presence/absence of the ink tank such that separate sensors are used to detect the presence/absence of the ink and the presence/absence of the ink tank, the optical ink tank sensor including a light emitter for projecting light onto the reflector and a light receiver for receiving a reflected light of the projected light.

The configuration eliminates the need for the relative movement of the sensor with respect to the ink tank, allowing both ink and the ink tank to be detected at the same time. Providing separate sensors, one for each detection, increases freedom in the reflector configuration.

More specifically, the carriage may include an ink tank holder for holding the ink tank and a resilient member normally urging the movable reflector in one direction for placing the reflector in the first position, one end of the reflector being supported on the ink tank holder such that when the ink tank is installed in the ink tank holder, the reflector is pressed down against a resilient power of the resilient member to place the reflector in the second position.

The use of the resilient member enables the reflector position to be changed and, at the same time, allows the ink tank in the ink tank holder more securely.

The reflector may have a part with the same material and the same structure as those of the prism installed on an inside bottom of the ink tank.

The resilient member may be a plate spring formed by using a part of the reflector. Of course, a spring separate from the reflector may also be used.

The prism may be constructed and placed such that, a ridge line of the prism is parallel with a scanning direction of the carriage and when the ink in the ink tank reaches at least near an empty state, an interface between the ink and air moves on the ridge as the ink decreases. This allows the amount of ink to be detected.

Another image forming device according to the present invention for forming an image with an ink jet method comprises an ink tank detachable on a carriage; a prism disposed in the ink tank, the prism being covered with ink when the tank is filled with ink and being exposed when the tank is empty; an optical ink sensor that has a light emitter for projecting light onto the prism and a light receiver for receiving a reflected light of the projected light to detect a presence/absence of ink in the ink tank; a reflector provided on an outer surface of the ink tank; and an optical ink tank sensor that has a light emitter for projecting light onto the reflector and a light receiver for receiving a reflected light of the projected light to detect a presence/absence of the ink tank, wherein the reflector, with the ink tank installed, reflects the light from the optical ink tank sensor back to the optical ink tank sensor and wherein the reflector, with no ink tank installed, does not return the light from the optical ink tank sensor back to the light receiver.

This is a case wherein the reflector is provided on the ink tank itself. This reflector may record thereon information of individual ink tanks that are readable by the optical ink tank sensor.

BRIEF DESCRIPTION OF DRAWINGS

FIG. 5 is a side view viewed from arrow A in FIG. 4;

FIGS. 6(*a*)–(*c*) are a top view (*a*) and a front view (*b*) of the reflector lever 35 in FIG. 5 and a side view (*c*) of another configuration example of the reflector lever 35;

FIGS. 20(*a*) and (*b*) are a diagram (*a*) and its side view (*b*) showing the configuration of a sensor corresponding to the configuration shown in FIG. 18

BEST MODE FOR CARRYING OUT THE INVENTION

Some preferred embodiments of the present invention will be described in detail below with reference to the attached drawings. It is to be understood that the embodiments are shown and described as examples and that various modifications or changes may be made.

In the description below, it is assumed that an ink sensor window is prism-structured and that an optical reflective sensor for monitoring this part is a prism-compatible reflective optical sensor.

Figure 1:
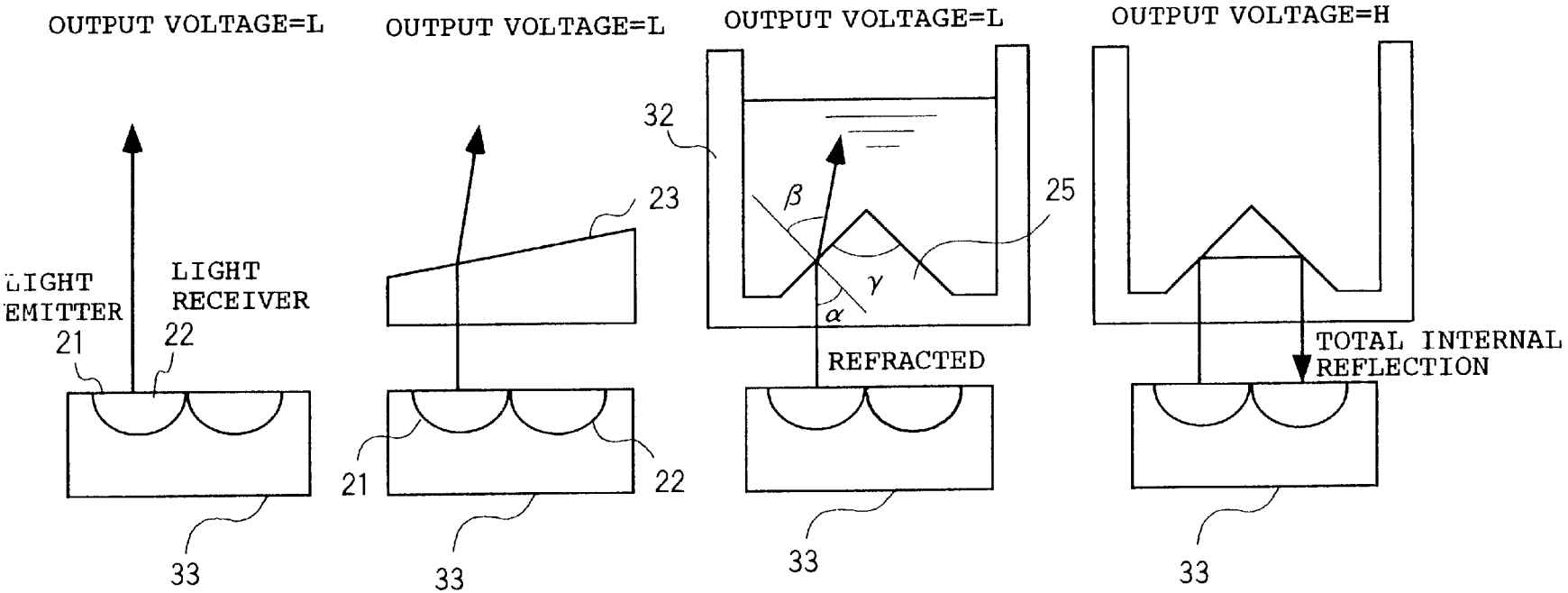
FIGS. 1(*a*)–(*d*) are diagrams showing the principle of ink detection with a combination of a light reflective prism and a reflective optical sensor.
Figure 2:
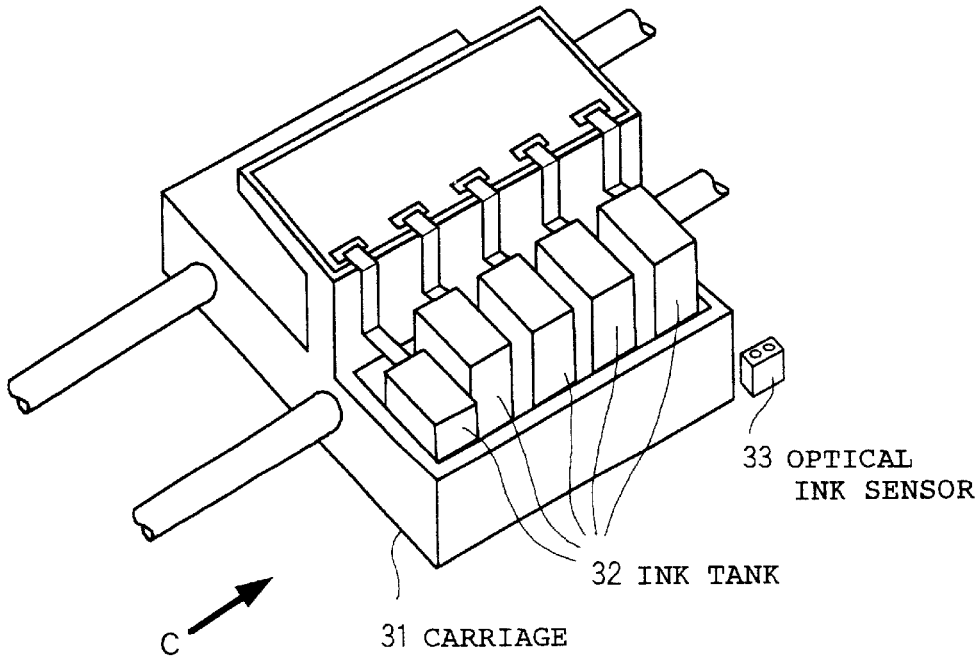
FIG. 2 is a diagram showing the general configuration of a carriage and its associated components of the image forming device shown in FIG. 3.

FIG. 2 is a general configuration diagram showing the carriage and associated components of this image forming device.

The image forming device comprises a carriage 31 capable of moving in a direction perpendicular to the media transport direction. This carriage 31 carries a plurality of ink tanks 32 thereon each having ink paths through which ink is supplied to the ink-jet nozzles. Each ink tank 32 has an ink sensor prism-structured window (that will be described below) according to the present invention. The relative movement of an optical ink sensor 33 in a direction relative to the ink sensor prism-structured windows of the ink tanks 32 is controlled by the carriage 31.

FIG. 2 shows an example of the configuration of the carriage 31 having an additional black ink tank provided, and offset in the media transport direction, to increase the print speed in black ink. However, this configuration is neither essential nor important in the present invention. To allow all ink tanks 32 to share the sensor 22, it is preferable that, for the additional black ink tank, the positions of a prism and the sensor window that will be described below be offset so that those positions are different from those of other ink tanks.

Figure 3:
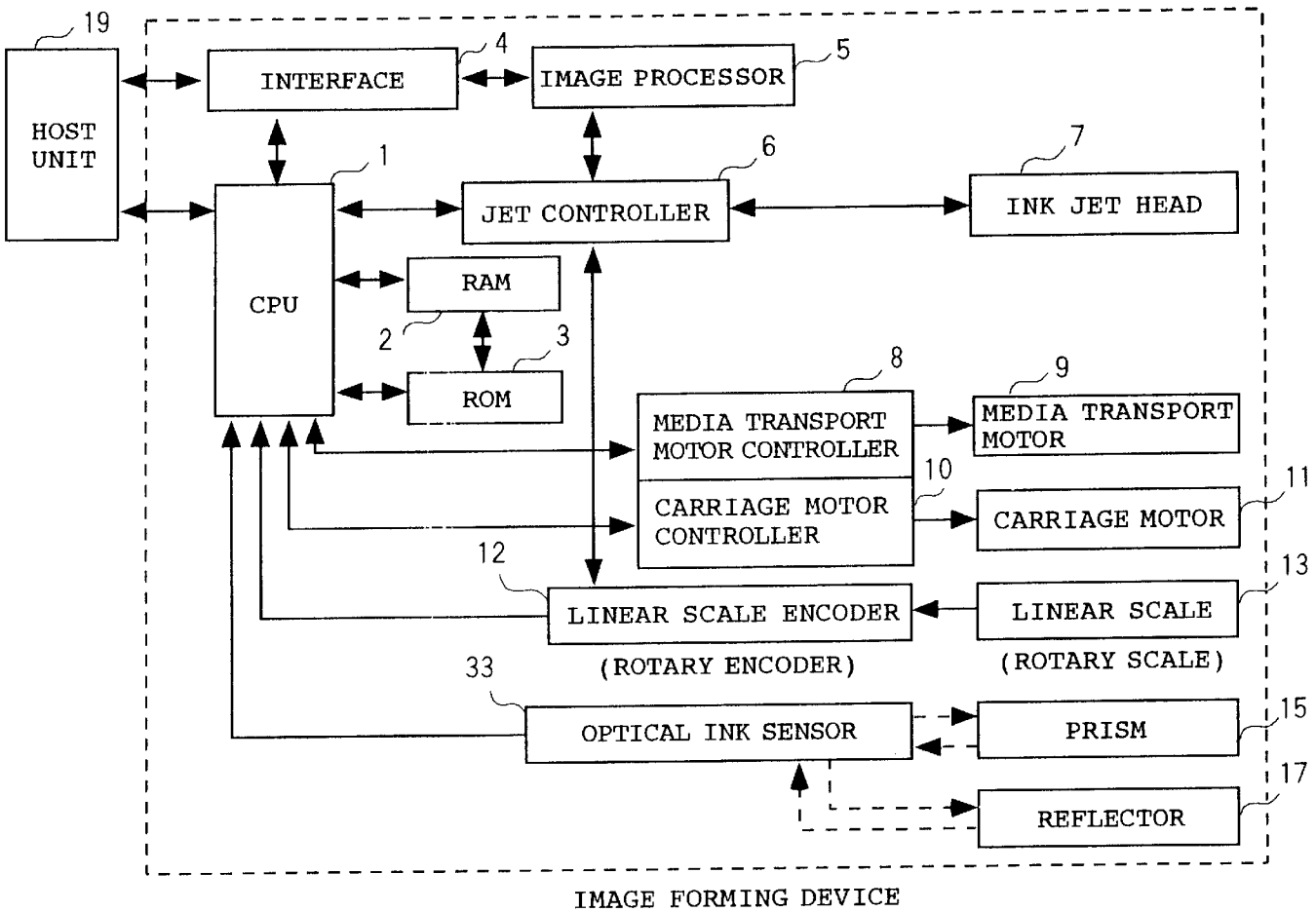
FIG. 3 is a block diagram showing the general configuration of an image forming device in an embodiment of the present invention.

FIG. 3 is a block diagram showing the general configuration of the image forming device in this embodiment. The image forming device comprises a central processing unit (CPU) 1, a temporary storage device (RAM) 2 in which various types of data or parameters are temporarily stored, a read-only non-volatile memory (ROM) 3 in which control programs corresponding to various operation modes and various types of fixed data are stored, an interface 4 that provides an interface with an external host unit 19, an image processor 5 that processes image data sent from the host unit 19 via the interface 4, and a jet controller 6 that controls ink to be ejected from an ink jet head 7 under control of the CPU 1 in response to print data received from the image processor 5. The image forming device further comprises a linear scale 13 that defines the individual reference dot positions in the carriage scanning direction, a linear scale encoder 12 that works with the linear scale, a media transport motor 9 that transports media such as paper, a media transport motor controller 8 that controls the motor under control of the CPU 1, a carriage motor 11 that causes the carriage to scan, and a carriage motor controller 10 that controls this motor under control of the CPU 1.

The image forming device in this embodiment further comprises the optical ink sensor 33, a prism 15, and a reflector 17. Preferably, the prism 15 is integrated in the ink tank 32. In this embodiment, light projection onto, and light reception from, the reflector 17 is performed by the optical ink sensor 33.

Although the linear scale 13 and the linear scale encoder 12 are used in this embodiment as means for sensing the amount of moving of the carriage 31, a rotary scale installed on a motor shaft driving the carriage 31 and a rotary encoder may also be used to implement this means. Alternatively, when a stepping motor is used, this means may be implemented by counting the pulses of the stepping motor driving signal. In this embodiment, the position and speed of the carriage 31 is sensed by the linear scale encoder 12 installed on the carriage 31, and the relative movement amount or the absolute position of the carriage 31 is sensed by the count of the output pulses from the linear scale encoder 12. In addition, the presence/absence of ink in the ink tank is detected by controlling the operation of the carriage 31 and by scanning the prism in the ink tank 32 on the carriage with the use of the optical ink sensor 33. As will be described below, the reflector 17 provided near the prism constitutes a part of means for detecting whether or not the ink tank 32 is on the carriage 31.

Figure 4:
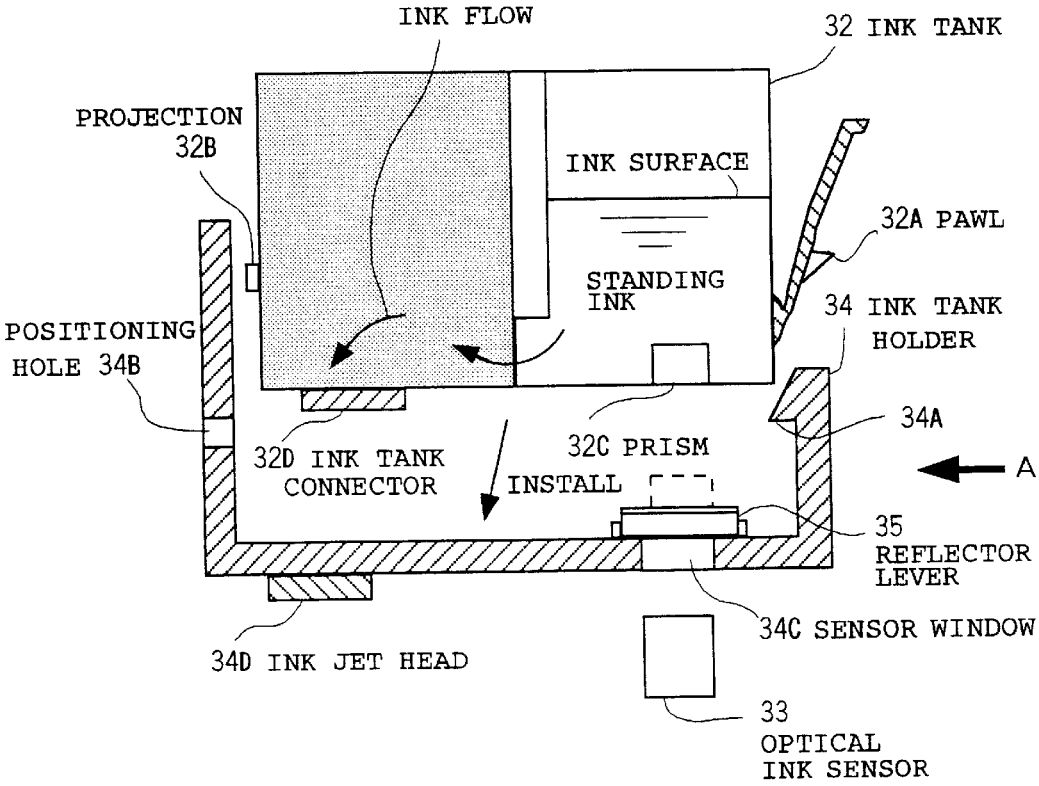
FIG. 4 is a diagram showing the configuration of an ink tank 32 and an ink tank holder 34 for detecting ink and an ink tank in the embodiment of the present invention.

FIG. 4 shows an example of the configuration of the ink tank 32 and an ink tank holder 34 that are used in this embodiment to detect the presence/absence of ink and the presence/absence of an ink tank.

Installing the ink tank 32 in the ink tank holder 34 causes a positioning hole 34B on the ink tank holder 34 to be engaged with a projection 32B on the ink tank and, at the same time, a lock 34A of the ink tank holder 34 to be engaged with a pawl 32A of the ink tank 32, setting the ink tank 32 in position in the ink tank holder 34.

A reflector lever 35 (corresponding to the reflector 17 shown in FIG. 3) is provided on the inside bottom of the ink tank holder 34. As shown in FIG. 5 showing the part indicated by arrow A in FIG. 4, the reflector lever 35 is supported on the wall of the ink tank holder 34 so that, with one end 35E being as a supporting point, a free end that is the other end may rock. Also, an ink jet head 34D is provided on the outside bottom of the ink tank holder 34. This ink jet head 34D is engaged with an ink tank connector 32D of the ink tank 32 to receive the ink supply. About half of the ink tank 32 to which ink tank connector 32D belongs is padded with a sponge-like ink absorbing member.

FIGS. 6(*a*) and 6(*b*) are the top view and the front view of the reflector lever 35, respectively. As indicated most clearly in FIG. 6(*a*), a reflector window 35B is provided about the center of the reflector lever 35. The light emitted by the optical ink sensor 33 reaches a prism 32C of the ink tank 32 via a sensor window 34C provided on the bottom of the ink tank holder and via the reflector window 35B and, then, the reflected light is received by the optical ink sensor 33 via the reflector window 35B and the sensor window 34C. This configuration allows the presence/absence of ink to be detected according to the principle described above. The free end of the reflector lever 35 is normally urged upward at its bottom by a resilient member 35A. The free end of the reflector lever 35 is projected outward from the ink tank to form a triangular reflector 35D whose cross section looks like a cone. This conical shape matches the conical shape of a prism 32C. When the optical ink sensor 33 is immediately below the triangular reflector 35D, the light from the light emitter of the optical ink sensor 33 is reflected on the slope of the reflector lever 35 and is directed in the direction different from the direction in which the light is received (see FIG. 8(*c*)). Installing the ink tank 32 in position in the ink tank holder 34 causes the reflector lever 35 to be pressed downward against the resilient member 35A. This puts the triangular reflector 35D of the reflector lever 35 in a state equivalent, on an optical and positional basis, to that of the prism 32C, causing the light from the emitter 21 of the sensor 33 to be reflected twice to allow the receiver 22 to receive the light and thus making it possible to detect the presence of the ink tank 32 (see FIG. 8(*b*)).

Figure 7:
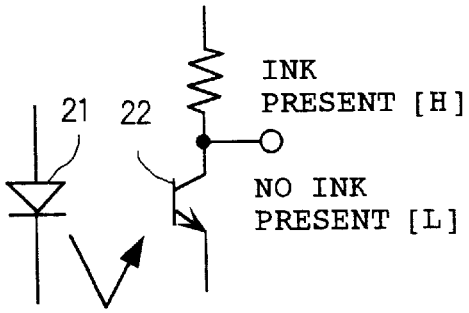
FIGS. 7(*a*), 7(*b*), and 7(*c*) are diagrams showing the output of ink detection and ink tank detection in the embodiment of the present invention.
Figure 7:
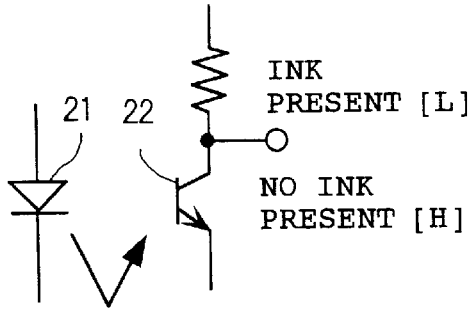

With reference to FIGS. 7(*a*), 7(*b*), and 7(*c*), the ink detection output and the ink tank detection output will be described. As shown in FIG. 7(*a*), when detecting the presence/absence of ink, the output of the receiver 22 is "H" if ink is present and is "L" if no ink is present. Also, as shown in FIG. 7(*b*), when detecting the ink tank, the output of the receiver 22 is "L" if an ink tank is present and is "H" if no ink tank is present. Therefore, the combination of both outputs is as shown in FIG. 7(*c*). That is, if an ink tank with ink is installed, the ink detection output and the ink tank detection output are "H" and "L", respectively. Also, if an ink tank with no ink is installed, the outputs are "L" and "L", respectively and, if the ink tank is not installed, the outputs are "H" and "H", respectively. In this way, the states may be determined by two-bit data. This configuration allows the presence/absence of ink to be detected reliably according to the outputs of the sensor. As a result, an alarm may be issued to the user as necessary.

Figure 8A:
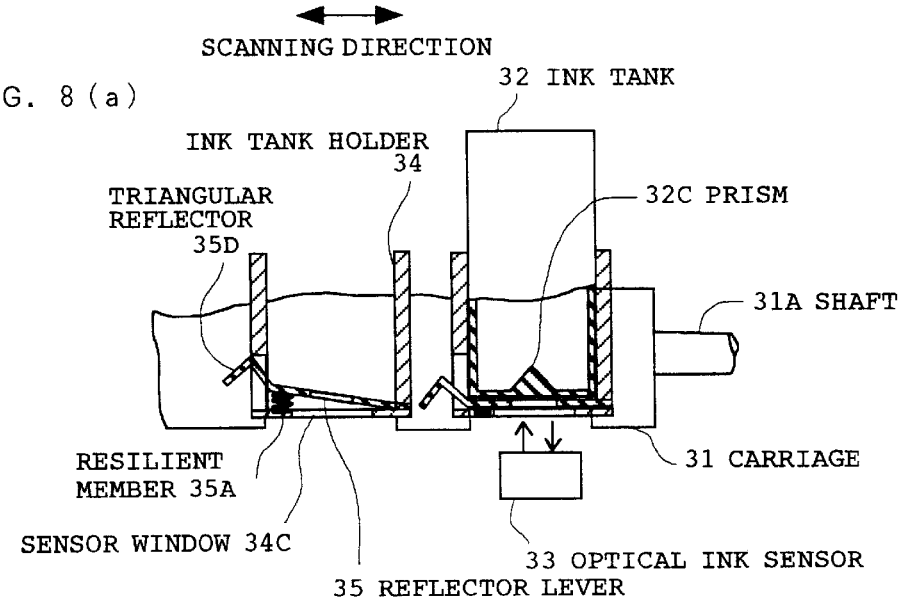
FIGS. 8(*a*), 8(*b*), and 8(*c*) are diagrams showing the use of a single optical ink sensor 33 in the embodiment of the present invention.
Figure 8B:
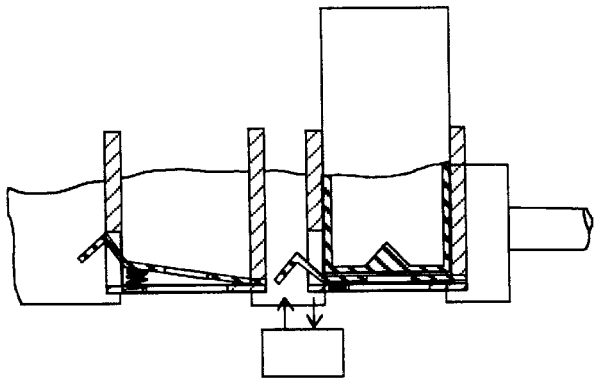
Figure 8C:
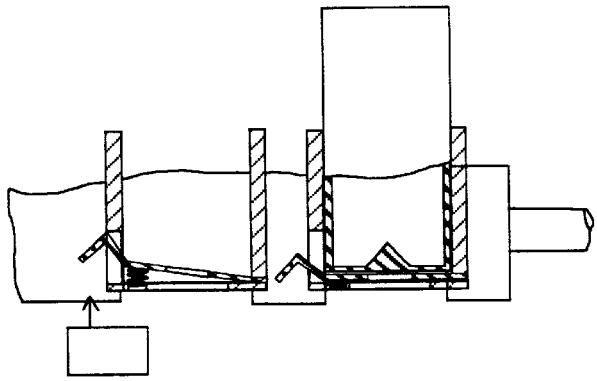

As shown in FIGS. 8(*a*), 8(*b*), and 8(*c*), a single optical ink sensor 33 is fixed at a predetermined position on the carriage movement path. Sequentially opposing the sensor window 34C and the triangular reflector 35D of the ink tanks 32, one at a time, against the light emitting-and-receiving surface of the optical ink sensor 33 allows the presence/absence of the ink tank 32 on the carriage 31 and the presence/absence of ink to be detected. Because the current position of the carriage 31 is known from the output of the linear scale encoder (12 in FIG. 3) and because the positions of each ink tank 32 on the carriage 31 and each triangular reflector 35D are also known in advance, where the carriage 31 should be positioned for detection may be identified in advance.

Figures 9A, 9B:
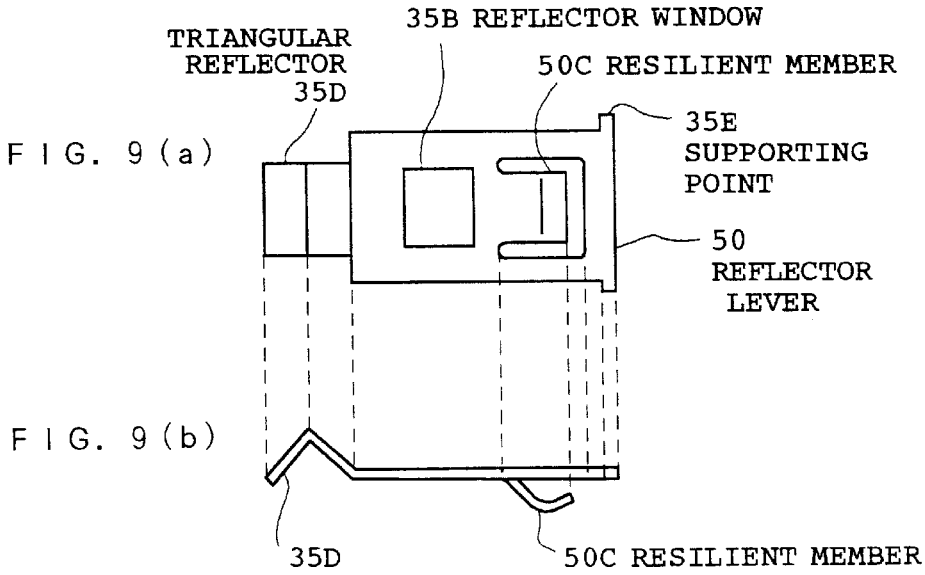
FIGS. 9(*a*) and (*b*) are diagrams showing a configuration example of a reflector lever 50 that is a modification of the reflector lever 35 in the embodiment of the present invention.

FIGS. 9(*a*) and 9(*b*) show a configuration example of a reflector lever 50 that is a modification of the reflector lever 35. This reflector lever 50 does not require the resilient member 35A that is an additional component. Instead, this reflector uses a part thereof as a resilient member (plate spring) 50C. The shape and the material of the resilient member 50C of the reflector lever determine the reaction force of this resilient member 50C. An SUS plate with a high reflection factor, if used as the material of the reflector lever 50, as well as a spring SUS material that is a resilient member, would make the reflector lever more slim and compact. Of course, surface processing such as plating increases the reflection factor. As shown in the side view in FIG. 6(*c*), a reflector lever with the same material and with the same structure as those of the prism on the inside bottom of the ink tank may also be used.

Figure 10:
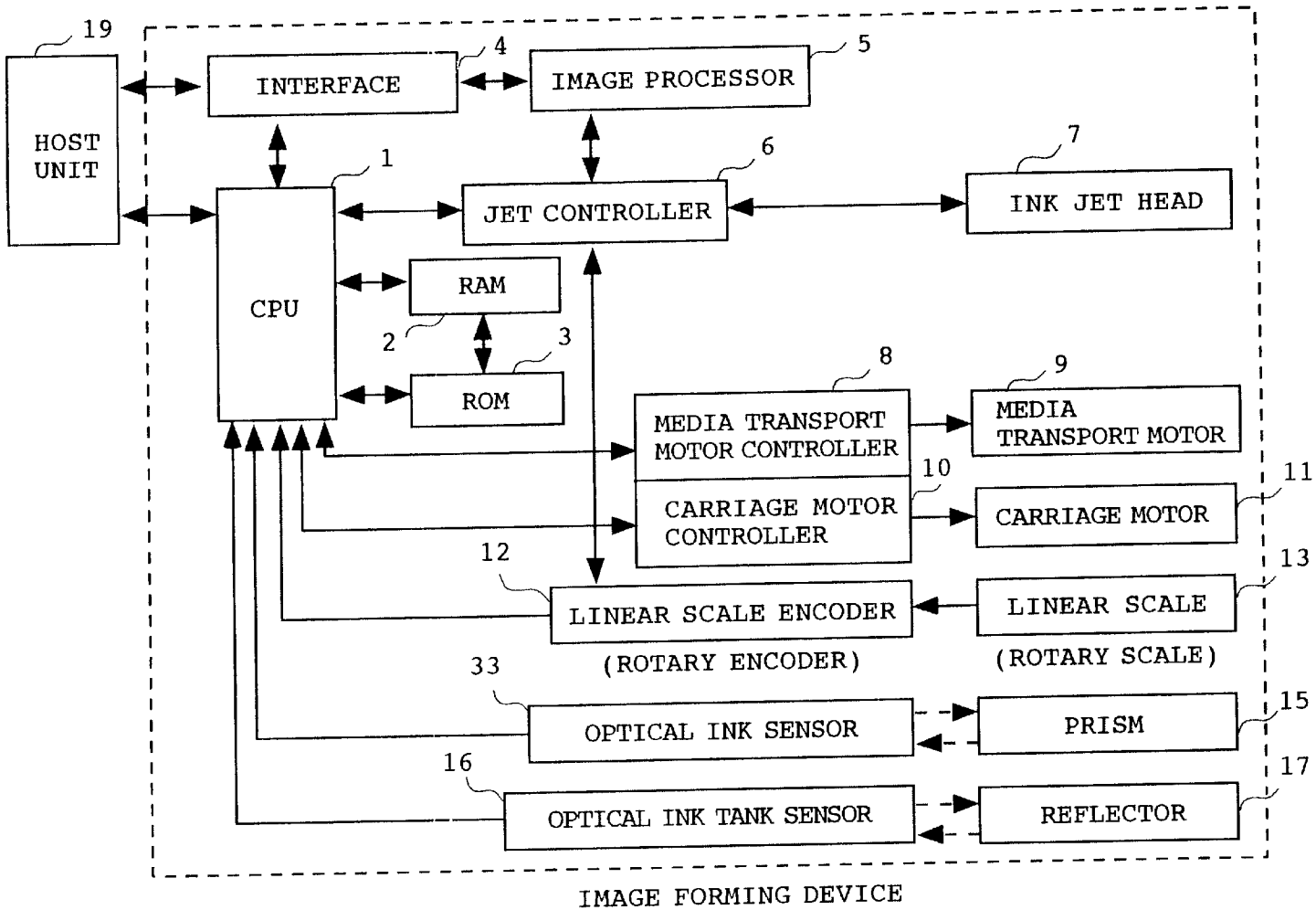
FIG. 10 is a block diagram showing the general configuration of an image forming device in a second embodiment of the present invention.

Next, FIG. 10 is a block diagram showing the general configuration of an image forming device in a second embodiment of the present invention. The same reference numerals shown in FIG. 3 represent the same structural elements. The configuration is almost similar to that shown in FIG. 3 but is different from the first embodiment in that a dedicated optical sensor 16 is provided for the reflector 17. The output of the reflector sensor 16 is identified by the CPU 1. This configuration makes it possible in this embodiment to detect the presence/absence of the ink tank 32 and the presence/absence of ink at the same time. Detecting them with separate sensors increases the freedom in the configuration of the reflector.

Figure 11:
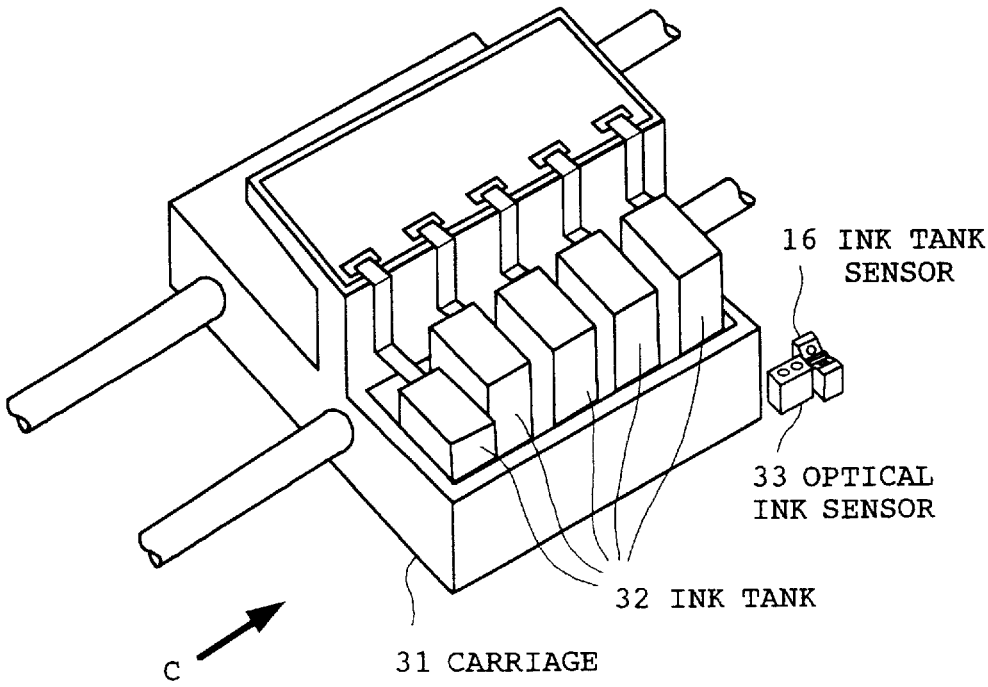
FIG. 11 is a general configuration diagram showing a carriage and its associated components in the embodiment shown in FIG. 10.

FIG. 11 is a diagram showing the general configuration of a carriage and associated components in the second embodiment. In this example, the optical ink sensor 33 and the reflector sensor 16 are fixed opposite to the carriage 31 in the image forming device as shown in the diagram.

Figure 12:
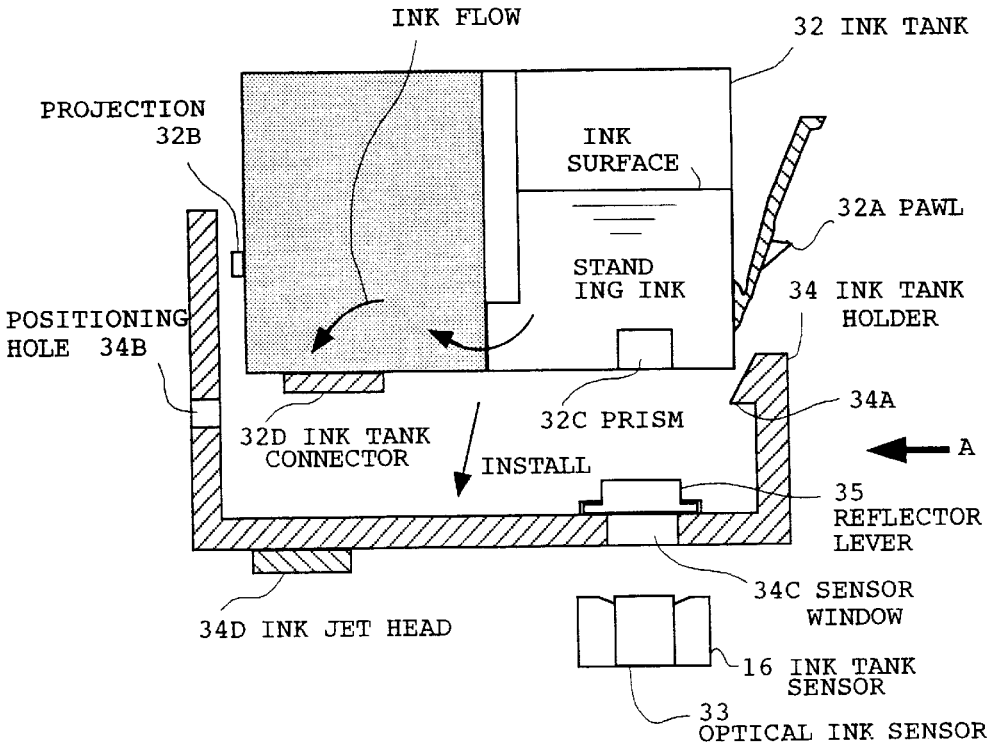
FIG. 12 is a diagram showing the configuration of ink and ink tank sensor in the embodiment shown in FIG. 10.
Figure 13:
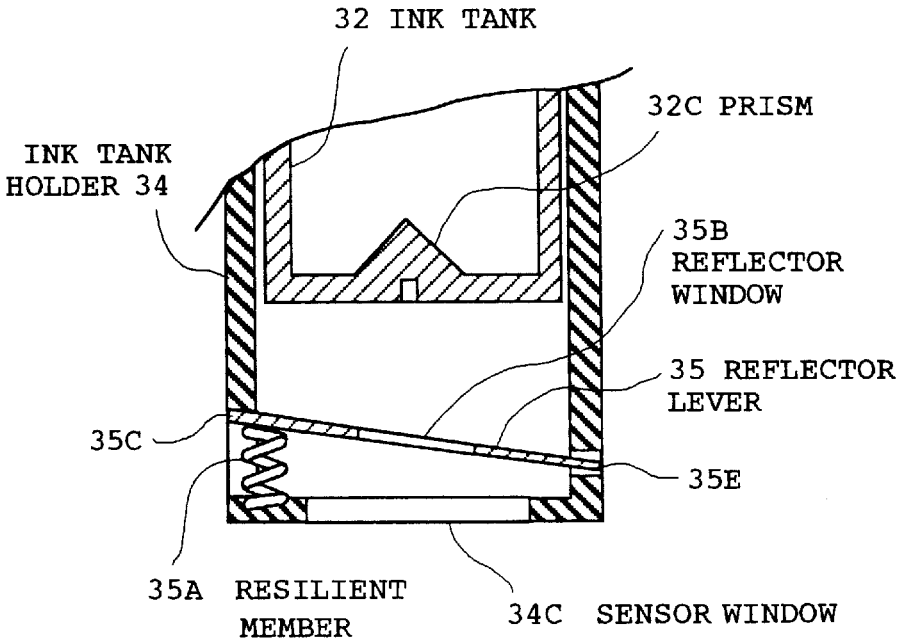
FIG. 13 is a side view viewed from arrow A in FIG. 11.
Figure 14:
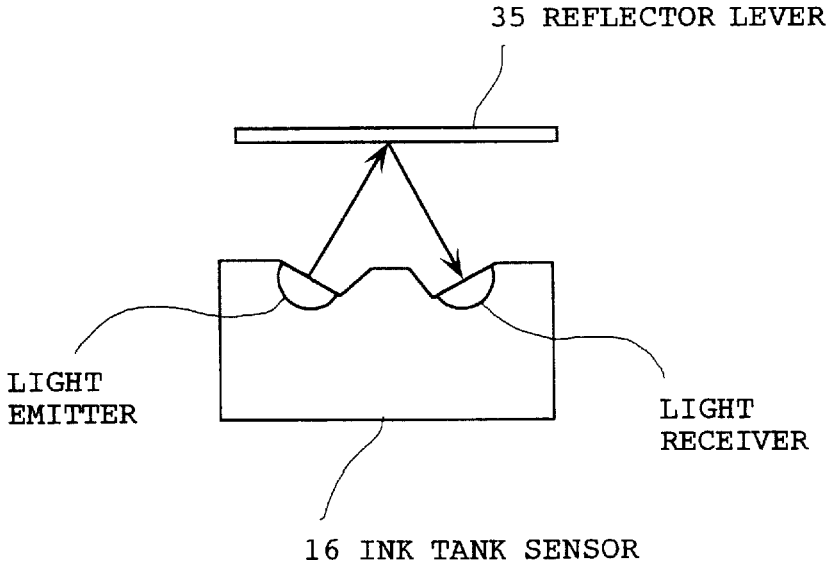
FIG. 14 is a diagram showing a configuration example of a reflector sensor 16 corresponding to the configuration shown in FIG. 13.

FIG. 12 shows the configuration of this embodiment for detecting ink and an ink tank. The figure shows the section of an ink tank 32 viewed from arrow C in FIG. 11. In the example in the figure, an optical ink sensor 33 is provided in front of, and adjacent to, the reflector sensor 16. As shown in FIG. 13 that is a section view showing a part of FIG. 12 viewed from arrow A, the reflector lever 35 does not have a triangular reflector 35D (FIG. 5) included in the configuration shown in FIG. 5. Instead, as shown in FIG. 14, the light is reflected on the flat part of the surface of the reflector lever 35. To be compatible with this configuration, the optical axes of the light emitter and the light receiver are tilted toward the center (This is the structure of a general reflective sensor having a certain focal length). In this state, the light received from the light emitter of the reflector sensor 16 via the sensor window 34C is reflected on the surface of the reflector lever 35, and the reflected light is directed in a direction different from the direction in which the light is received. If the ink tank 32 is set in position in the ink tank holder 34, the reflector lever 35 is pressed downward against the force of the resilient member 35A. This makes the light emitting/receiving surface of the reflector sensor 6 almost parallel with the reflector lever 35, enabling the installation of the ink tank 32 to be detected. At the same time, the optical ink sensor 33 enables the presence/absence of ink to be detected via the prism 32C.

Figures 15A, 15B:
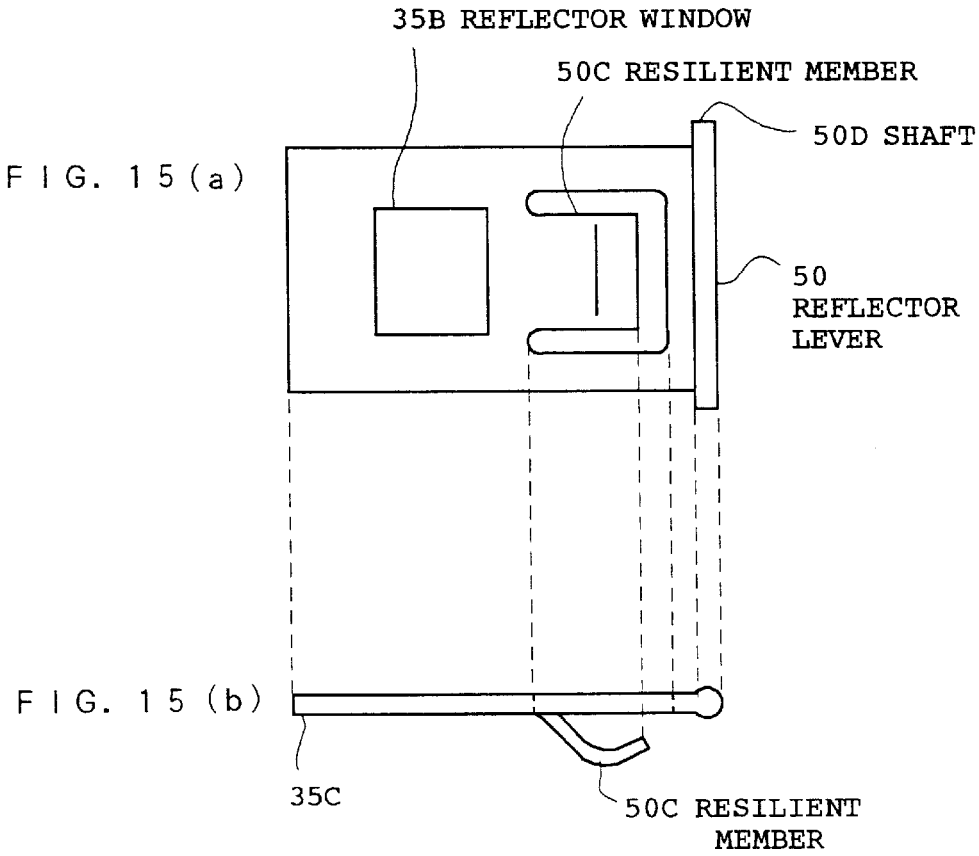
FIGS. 15(*a*) and (*b*) are diagrams showing an modification of the reflector lever in the embodiment shown in FIG. 10.

Like the configuration in the first embodiment shown in FIGS. 9(*a*) and 9(*b*), a part of the reflector lever 50 may be used also in the second embodiment to configure a resilient member 50C as shown in FIGS. 15(*a*) and 15(*b*).

Figure 16:
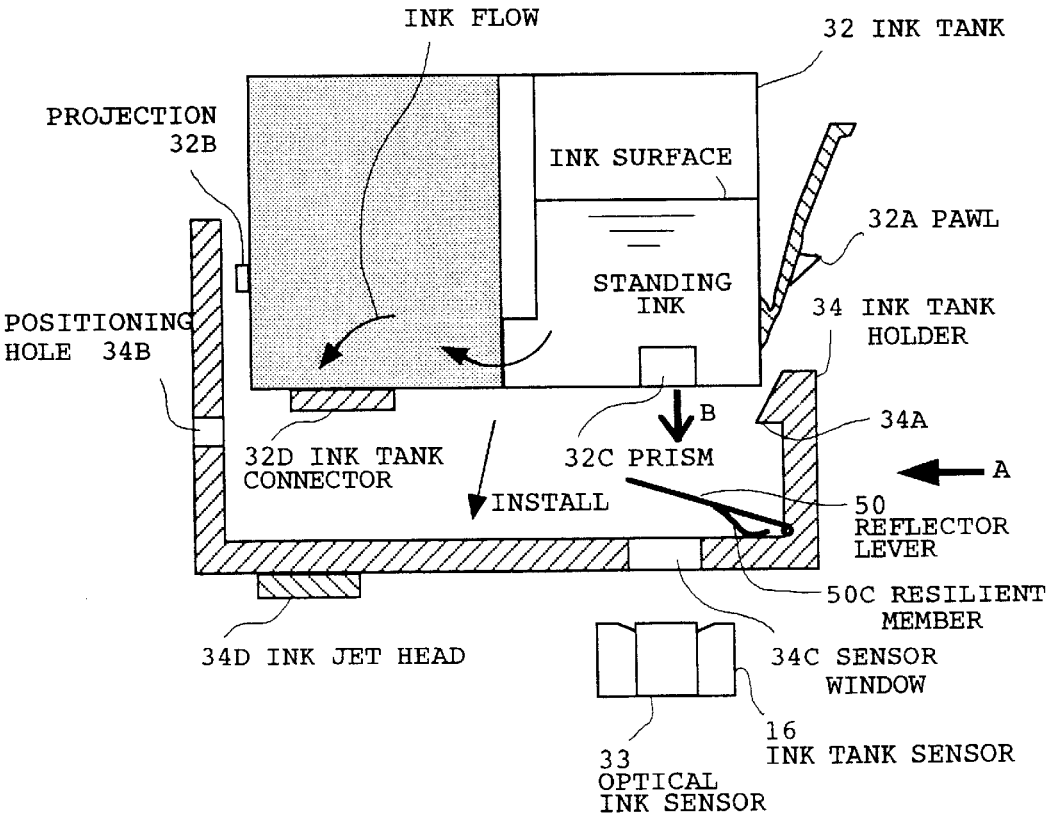
FIG. 16 is a diagram showing a configuration example of an ink tank holder using the reflector lever shown in FIG. 15.

As shown in FIG. 16, the reflector lever 50 may also be at a position 90° different in the rocking axis direction from that of the reflector lever in the example given above (for example, FIG. 4 or FIG. 5). That is, the reflector lever 50 may be extended from the supporting point in the direction indicated by arrow A.

Figure 17:
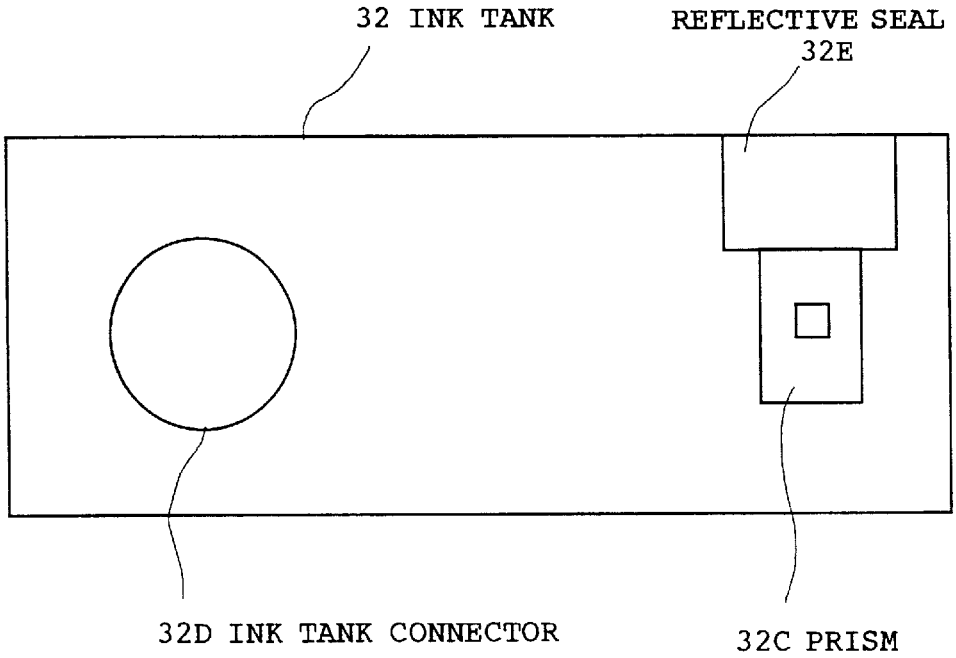
FIG. 17 is a diagram showing a configuration example of the reflector according to the present invention.

FIG. 17 is a still another configuration example of the reflector. In this example, the reflector is provided on the ink tank 32 itself. That is, a reflective seal 32E is attached near the prism 32C in the ink tank 32 to allow the reflector sensor 16 shown in FIG. 14 to detect the seal. In this configuration, the reflective seal 32E may have an information recording function such as a bar code. By scanning this bar code with the use of the sensor 16, the color of the ink tank 32 may be identified. In addition, additional information such as individual information may be read.

The method described above, which has the ability to detect the presence/absence of ink and an ink tank as well as the ability to read information on each ink tank and color identification information, gives better and more efficient determination results.

Figure 18:
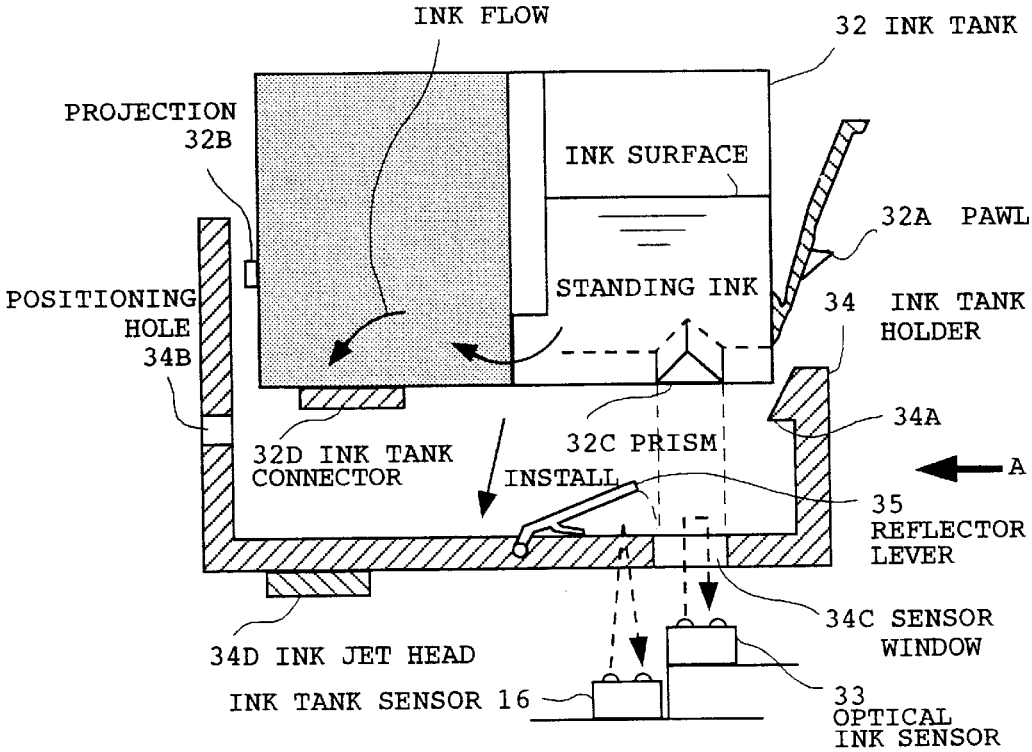
FIG. 18 is a diagram showing the configuration of a prism and the configuration of a sensor for detecting the presence/absence of ink according to the present invention.
Figure 19:
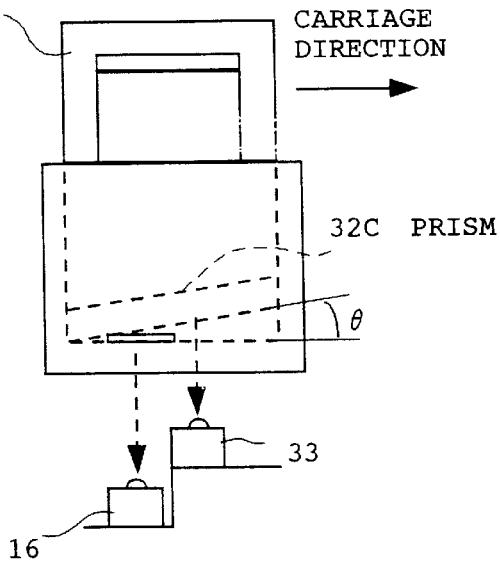
FIG. 19 is a side view viewed from arrow A in FIG. 18.

Although the ridge line of the prism is perpendicular to the carriage scanning direction in the above embodiment, the ridge line of the prism may be in the same direction as the carriage scanning direction and the sensor may be placed accordingly as proposed by the present applicant in Japanese Patent Application No. Hei 10-296148. Such an example is shown in FIG. 18. Also, the side view of the configuration in FIG. 18, viewed from the direction of arrow A, is shown in FIG. 19. In this example, the ridge line of the prism 32C is in the same direction as the carriage scanning direction and, in addition, the ridge line of the prism is long and is inclined (θ in FIG. 19) to the horizontal plane (bottom of the ink holder). As the carriage scans, the sensor window 34C of the ink tank holder 34 is scanned in the lengthwise direction of the prism. As this scan is made, it is assumed that the distance between the optical ink sensor 33 and the prism 32C varies only within the detection effective range. Then, by detecting a change in the output level of the sensor 33 or by calculating the position of the ink surface that forms the interface between the prism with an inclination of an angle (θ) by using the linear scale encoder described above, not only the presence/absence of ink in the ink tank 32 but also a change in the amount of ink may be checked.

As shown in the front view in FIG. 20(*a*) and in the side view in FIG. 20(*b*), the sensor 33 may have a contact-sliding, partially-movable detection mechanism on the inclined bottom of the ink tank 32 such that the distance between the optical ink sensor 33 and the prism 32C remains unchanged. To implement this mechanism, the optical ink sensor 33 is supported by a resilient member and has a member that contacts the bottom of the ink tank 32 for keeping a predetermined amount of space against the sensor surface.

While the preferred embodiments of the present invention have been described, various modification and changes are possible. For example, although the prism and the ink tank are integrated into one in the embodiments, a prism and an ink tank, which are separate, may be connected.

Industrial Applicability

The present invention is applicable to the design and manufacturing of an image forming device such as an ink jet printer and a plotter. The present invention provides an easy method for detecting the presence/absence of ink using a refraction determined by ink and the material of the prism in an ink tank and for detecting an ink tank on the carriage by using a reflector near the prism, thus preventing an ink detection error which would occur when the ink tank is removed. In addition, a very simple structure of the ink tank increases the ink tank detection function and reliability. In addition, a reflective plate where information is recorded, if provided on the ink tank itself, allows the ink tank to be identified and prevents the ink tank from being installed improperly.

What is claimed is:

1. An image forming device for forming an image with an ink jet method, comprising:

an ink tank which is detachable on a carriage;

a prism disposed in said ink tank, said prism being covered with ink when the tank is filled with ink and being exposed when the tank is empty;

an optical ink sensor that has a light emitter for projecting light onto said prism and a light receiver for receiving a reflected light of the projected light to detect a presence/absence of ink in said ink tank; and a reflector movable between a first position and a second position according to whether or not said ink tank is installed on said carriage;

wherein said reflector, in said second position with the ink tank installed, reflects the light from said optical ink sensor back to said optical ink sensor and wherein said reflector, in said first position with no ink tank installed, does not return the light from said optical ink sensor back to said light receiver;

said carriage including an ink tank holder for holding the ink tank on said carriage and a resilient member normally urging said movable reflector in one direction for placing said reflector in said first position, one end of said reflector being supported on the ink tank holder, and wherein, when the ink tank is installed in said ink tank holder, said reflector is pressed down against a resilient power of said resilient member to place said reflector in said second position.

2. The image forming device according to claim 1, wherein said optical ink sensor is used both to detect the presence/absence of ink and to detect the presence/absence of said ink tank.

3. The image forming device according to claim 2 wherein said prism is constructed and placed such that, a ridge line of said prism is parallel with a scanning direction of said carriage and when the ink in said ink tank reaches at least near an empty state, an interface between the ink and air moves on said ridge as the ink decreases.

4. The image forming device according to claim 2, wherein said reflector has a part with the same material and the same structure as those of said prism installed on an inside bottom of said ink tank.

5. The image forming device according to claim 1, wherein said reflector has a part with the same material and the same structure as those of said prism installed on an inside bottom of said ink tank.

6. The image forming device according to claim 1, further comprising an optical ink tank sensor for detecting a presence/absence of said ink tank such that separate sensors are used to detect the presence/absence of the ink and the presence/absence of said ink tank, said optical ink tank sensor including a light emitter for projecting light onto the reflector and a light receiver for receiving a reflected light of the projected light.

7. The image forming device according to claim 1, wherein said reflector has a part with the same material and the same structure as those of said prism installed on an inside bottom of said ink tank.

8. The image forming device according to claim 1 wherein said resilient member is a plate spring formed by using a part of said reflector.

9. An image forming device for forming an image with an ink jet method, comprising:

an ink tank which is detachable on a carriage;

a prism disposed in said ink tank, said prism being covered with ink when the tank is filled with ink and being exposed when the tank is empty;

an optical ink sensor that has a light emitter for projecting light onto said prism and a light receiver for receiving a reflected light of the projected light to detect a presence/absence of ink in said ink tank;

a reflector provided on an outer surface of said ink tank; and an optical ink tank sensor that has a light emitter for projecting light onto said reflector and a light receiver for receiving a reflected light of the projected light to detect a presence/absence of said ink tank, wherein said reflector, with the ink tank installed, reflects the light from said optical ink tank sensor back to said optical ink tank sensor and wherein said reflector, with no ink tank installed, does not return the light from said optical ink tank sensor back to said light receiver; and wherein said reflector has a bar code recorded on the ink tank for individual ink tanks, said bar code being readable by said optical ink tank sensor.

10. A method for detecting a presence/absence of ink in an ink tank of an image forming device which forms an image with an ink jet method, said method comprising the steps of:

projecting light onto a prism for obtaining a first detection signal according to whether or not a reflected light is present, said prism being provided in an ink tank which is detachable on a carriage, said prism being covered with ink when the ink tank is filled with ink and being exposed when the ink tank is empty;

projecting light onto a reflector for obtaining a second detection signal according to whether or not a reflected light is present, said reflector being movable between a first position and a second position according to whether or not said ink tank is installed on said carriage; and based on said first and second detection signals, detecting the presence/absence of said ink tank on said carriage and the presence/absence of the ink in said ink tank;

said resilient member normally urging said movable reflector in one direction for placing said reflector in said first position, one end of said reflector being supported on the ink tank holder, and wherein, when said ink tank is installed in said ink tank holder, said reflector is pressed down against a resilient power of said resilient member to place said reflector in said second position.

* * * * *